US008974141B2

(12) United States Patent
Williford

(10) Patent No.: US 8,974,141 B2
(45) Date of Patent: Mar. 10, 2015

(54) PADDLE CONVERTER

(71) Applicant: Eddie Williford, Monticello, FL (US)

(72) Inventor: Eddie Williford, Monticello, FL (US)

( * ) Notice: Subject to any disclaimer, the term of this patent is extended or adjusted under 35 U.S.C. 154(b) by 146 days.

(21) Appl. No.: 13/959,562

(22) Filed: Aug. 5, 2013

(65) Prior Publication Data

US 2015/0037094 A1 Feb. 5, 2015

(51) Int. Cl.
*F16G 11/06* (2006.01)
*B63H 16/04* (2006.01)

(52) U.S. Cl.
CPC ..... *B63H 16/04* (2013.01)
USPC ..... 403/396; 440/101

(58) Field of Classification Search
USPC ..... 440/101; 403/286, 389–393, 396
See application file for complete search history.

(56) References Cited

U.S. PATENT DOCUMENTS

| | | | | | |
|---|---|---|---|---|---|
| 3,353,774 | A * | 11/1967 | Thomas | 248/68.1 |
| 5,282,555 | A * | 2/1994 | Muir et al. | 224/532 |
| 5,395,018 | A * | 3/1995 | Studdiford | 224/420 |
| 5,460,458 | A * | 10/1995 | Caceres | 403/109.5 |
| 5,593,076 | A * | 1/1997 | Biondo | 224/488 |
| 5,598,995 | A * | 2/1997 | Meuth et al. | 248/74.3 |
| 8,123,635 | B2 * | 2/2012 | Gillis | 473/450 |

* cited by examiner

*Primary Examiner* — Michael P Ferguson
*Assistant Examiner* — Daniel Wiley
(74) *Attorney, Agent, or Firm* — Superior IP, PLLC; Dustin L. Call

(57) ABSTRACT

A paddle converter for securing two singled bladed canoe paddles to form a single twin bladed kayak paddle. The paddle converter includes a body configured to structurally support a first canoe paddle and a second canoe paddle. The paddle converter also includes a groove on the body configured to receive the shaft of the first canoe paddle. The paddle converter further includes a grip match configured to match the grip of the first canoe paddle. The paddle converter additionally includes a fastener configured to secure the shaft of the first canoe paddle within the groove.

16 Claims, 5 Drawing Sheets

PADDLE CONVERTER

CROSS-REFERENCE TO RELATED APPLICATIONS

Not applicable.

BACKGROUND OF THE INVENTION

Frequently, canoe users find that a singled bladed canoe paddle is less effective than would be a doubled bladed kayak paddle. Users may wish to convert between canoe paddles and a kayak paddle for a number of reasons. For example, the user may be paddling alone, windy conditions may arise, or the user's partner tires out or wants to do something else like take pictures. However, current methods of allowing a canoeist to choose between canoe paddles and kayak paddles are less than satisfactory for a number of reasons.

For example, there are other paddles that convert from single to double by using a push button and spring lock. These paddles must be purchased with the spring lock. This makes this solution both inapplicable for existing canoe paddles and also dramatically increases the cost of the canoe paddles.

Alternatively, some canoeists take both single and double bladed paddles in the canoe with them. Storing the double bladed paddle while paddling with the single blade is very bothersome as is storing the single bladed paddles while paddling with the double bladed paddle. Space is at a premium in the canoe and the extra paddles are a waste that is often more trouble than it is worth.

Accordingly, there is a need in the art for an inexpensive device which can be used to secure two canoe paddles in a configuration that they can be used as a single kayak paddle. Further, there is a need in the art for the device to be as small as possible, to preserve space within the canoe. Moreover, there is a need in the art for the device to be simple to use.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a paddle converter for securing two singled bladed canoe paddles to form a single twin bladed kayak paddle. The paddle converter includes a body configured to structurally support a first canoe paddle and a second canoe paddle. The paddle converter also includes a groove on the body configured to receive the shaft of the first canoe paddle. The paddle converter further includes a grip match configured to match the grip of the first canoe paddle. The paddle converter additionally includes a fastener configured to secure the shaft of the first canoe paddle within the groove.

Another example embodiment includes a paddle converter for securing two singled bladed canoe paddles to form a single twin bladed kayak paddle. The paddle converter includes a body configured to structurally support a first canoe paddle and a second canoe paddle. The paddle converter also includes a first groove on a first side of the body configured to receive the shaft of the first canoe paddle and a second groove on a second side of the body configured to receive the shaft of the second canoe paddle, wherein the second side of the body is opposite the first side of the body.

The paddle converter further includes a first grip match on a first end of the body configured to match the grip of the first canoe paddle and a second grip match on a second end of the body configured to match the grip of the second canoe paddle wherein the second end of the body is opposite the first end of the body. The paddle converter additionally includes a first strap configured to secure the shaft of the first canoe paddle within the first groove and the shaft of the second canoe paddle within the second groove at a first location and a second strap configured to secure the shaft of the first canoe paddle within the first groove and the shaft of the second canoe paddle within the second groove at a second location.

Another example embodiment includes a method of securing two singled bladed canoe paddles to form a single twin bladed kayak paddle. The method includes providing a body configured to structurally support a first canoe paddle and a second canoe paddle. The method also includes securing the shaft of the first canoe paddle in a first groove on a first side of the body. The method further includes securing the shaft of the second canoe paddle in a second groove on a second side of the body, wherein the second side of the body is opposite the first side of the body.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
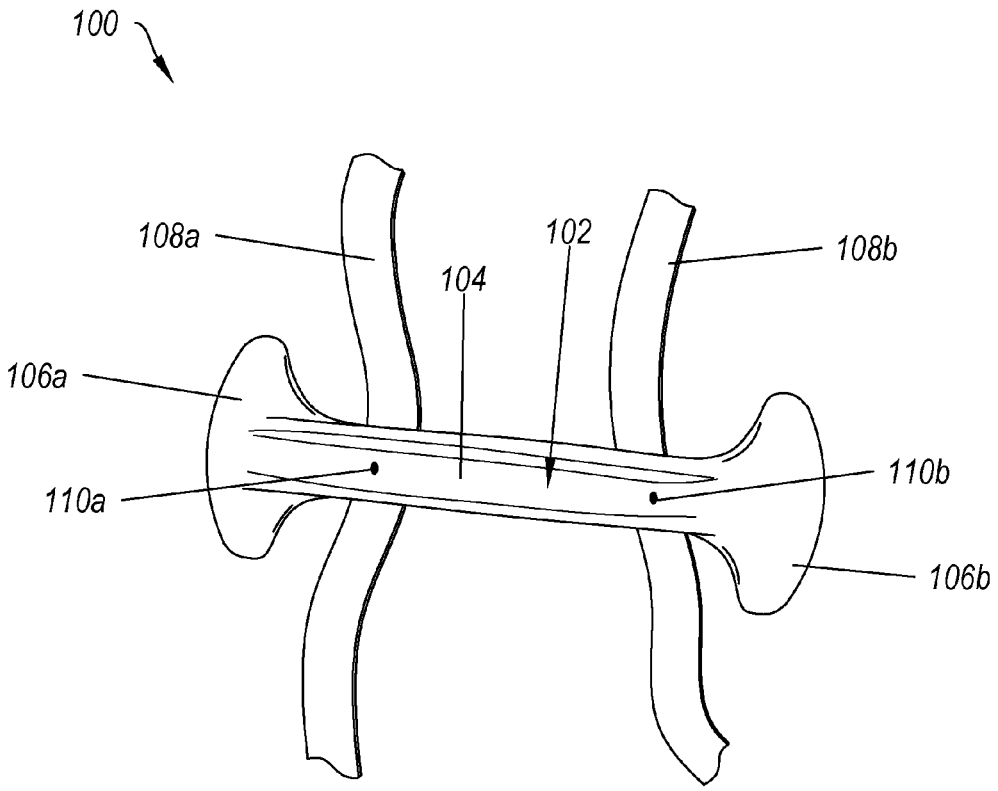
FIG. 1 illustrates an example of a paddle converter.

FIG. 1 illustrates an example of a paddle converter 100. The paddle converter 100 can be used to secure two singled bladed canoe paddles to form a single twin bladed kayak paddle. Users may wish to convert between canoe paddles and a kayak paddle for a number of reasons. For example, the user may be paddling alone, windy conditions may arise, or the user's partner tires out or wants to do something else like take pictures.

Canoe paddles include the following parts:

Grip—The handle formed on the top of the paddle shaft;

Shaft—The section of the paddle between the grip and paddle blade;

Throat—The transition point between the shaft and paddle blade;

Paddle Blade—The portion of the paddle that contacts the water;

Powerface—The face of the paddle blade that contacts the water during a forward stroke;

Backface—The face of the paddle blade opposite of the powerface; and

Tip—The extreme end of the paddle blade

In addition, canoe paddles can include the following configurations:

Straight Shaft Paddles—Canoeists that paddle from a kneeling position prefer these paddles and they are the most commonly produced paddles. Paddling can be accomplished with either face of the paddle blade; and Bent Shaft Paddles—These paddles have a bend at the shaft throat of 10 to 15 degrees (i.e., the major axis of the shaft and the blade are not in line with one another) making them easier to use for seated paddlers. Bent shaft paddles can only be used with their bend angle facing forward. Forward movement is more efficient, but turning strokes are more difficult with these paddles.

Canoe paddles and kayak paddles have a number of different characteristics. These characteristics may be advantageous in some settings and detrimental in others. Therefore, allowing a user to change from a canoe paddle to a kayak paddle allows the user to take advantage of desired characteristics when conditions dictate.

Paddles commonly used in canoes consist of a wooden, fiberglass, carbon fiber or metal rod (the shaft) with a handle on one end and a rigid sheet (the blade) on the other end. Paddles for use in kayaks are longer, with a blade on each end; they are handled from the middle of the shaft. Kayak paddles having blades in the same plane (when viewed down the shaft) are called "un-feathered." Paddles with blades in different planes are called "feathered". Feathered paddles are measured by the degree of feather, such as 30, 45, or even 90 degrees. The shaft may be straight or may have a 'crank' added with the aim of making the paddle more comfortable and reducing the strain on the user's wrist. Because both canoe and kayak paddle are not supported by the boat, paddles made of lighter materials are desired; it is not uncommon for a kayak paddle to be two pounds (32 ounces) or less in weight and very expensive paddles can be as light as 22 ounces.

Cheaper paddles have an aluminum shaft while more expensive ones use a lighter fiberglass or carbon fiber shaft. Some paddles have a smaller diameter shaft for people with smaller hands. Paddle length varies with a longer paddle being better suited for stronger people, taller people, and people using the paddle in a wider kayak. Blades also vary in size and shape. A blade with a larger surface area may be desirable for a strong person with good shoulder joints, but tiring for a weaker person or a person with weaker shoulder joints.

A kayak paddle is held with two hands, some distance apart from each other with the hands equally spaced from the center point of the shaft. For normal use, it is drawn through the water from front (bow) to back (stern) to drive the boat forward. The two blades of a kayak paddle are dipped alternately on either side of the kayak. In contrast, a canoe paddle is held with two hands, one on the end (which usually has a grip) and the second hand on the shaft. The blade is drawn through the water from front (bow) to back (stern) to drive the boat forward. The canoe is then lifted, passed over the boat and placed in the water on the opposite side of the canoe, where the driving motion is repeated.

FIG. 1 shows that the paddle converter 100 can include a body 102. The body 102 is configured to structurally support the canoe paddles when secured to one another forming a kayak paddle. I.e., the body 102 provides a structural intermediary between the canoe paddles, converting them into a kayak paddle. In addition, the body 102 can include a twist or curve that allows the paddles to be feathered relative to one another if the user so desires. Further, the body 102 can include any desired material that is of sufficient strength to secure the canoe paddles. For example, the body 102 can be made of plastic, wood, metal or any other desired material.

By way of example, the body 102 can be between 10 inches and 14 inches long (i.e., in the direction that aligns with the shafts of the canoe paddles). In particular, the body 102 can be approximately 12 inches long. Additionally or alternatively, the body 102 can be between 3 inches and 5 inches wide (i.e., perpendicular to the shafts when secured). In particular, the body 102 can be approximately 4 inches wide. Proper dimensions are critical to ensure that the kayak paddle can be used in a normal manner and that the below advantages are obtained. The body 102 can allow sufficient overlap to prevent rotation of the paddle shafts relative to one another without being overly bulky which would increase the weight and discomfort of the user. Further, the body 102 can be sized to prevent rotation of the paddle blades relative to one another. I.e., the body 102 can be sized and shaped to prevent a feathering configuration other than the configuration intended. As used in the specification and the claims, the term approximately shall mean that the value is within 10% of the stated value, unless otherwise specified.

FIG. 1 also shows that the paddle converter 100 can include grooves 104. The grooves 104 are configured to receive the shafts of the canoe paddles. I.e., the shafts of the canoe paddles are secured in the grooves 104. The grooves 104 can prevent rotation of the shaft relative to the body 102. I.e., the grooves 104 can ensure that the shafts of the two canoe paddles remain straight or in line relative to one another when used as a kayak paddle. The grooves 104 can be internal (i.e., the sides are the same depth as the body 102) or can be external (i.e., the sides protrude from the body 102).

FIG. 1 further shows that the paddle converter 100 can include a first grip match 106*a* and a second grip match 106*b* (collectively "grip matches 106"). The grip matches 106 can be configured to match the grip of the canoe paddle. I.e., the grip matches 106 can be approximately the same size and shape as the grip of the canoe paddle. The first grip match 106*a* can be opposite the second grip match 106*b* along the major axis of the paddle converter 100.

FIG. 1 additionally shows that the paddle converter 100 can include a first strap 108*a* and a second strap 108*b* (collectively "straps 108"). The straps 108 can be used to secure the shafts of the canoe paddles within the groove 104. In particular, the first strap 108*a* can secure the first shaft and the second shaft to the body 102 in a first location and the second strap 108*b* can secure the first shaft and the second shaft to the body 102 at a second location. Two attachment locations can allows the shafts to remain in line in the desired configuration. One of skill in the art will appreciate that the two attachment locations can be replaced with a single long attachment location. I.e., if enough of the shaft is secured at a single location, then a single attachment will function equivalent to two attachment points. One of skill in the art will appreciate that the straps 108 can include any desired material and/or fasteners. For example, the straps can include a hook and loop fastener, buttons, snaps or any other desired fastener. Although straps 108 are used as exemplary herein, one of skill in the art will appreciate that any fastener configured to secure the shafts within the groves 104 is contemplated herein.

FIG. 1 moreover shows that the paddle converter 100 can include a first attachment 110*a* and a second attachment 110*b* (collectively "attachments 110"). The attachments 110 can secure the straps 108 in a fixed position relative to the body 102. In particular, the attachments 110 can ensure that the straps 108 are in correct position relative to the body 102. For example, the attachments 110 can include a rivet, slots, snaps or any other means for attaching the straps 108 to the body 102.

Figure 2:
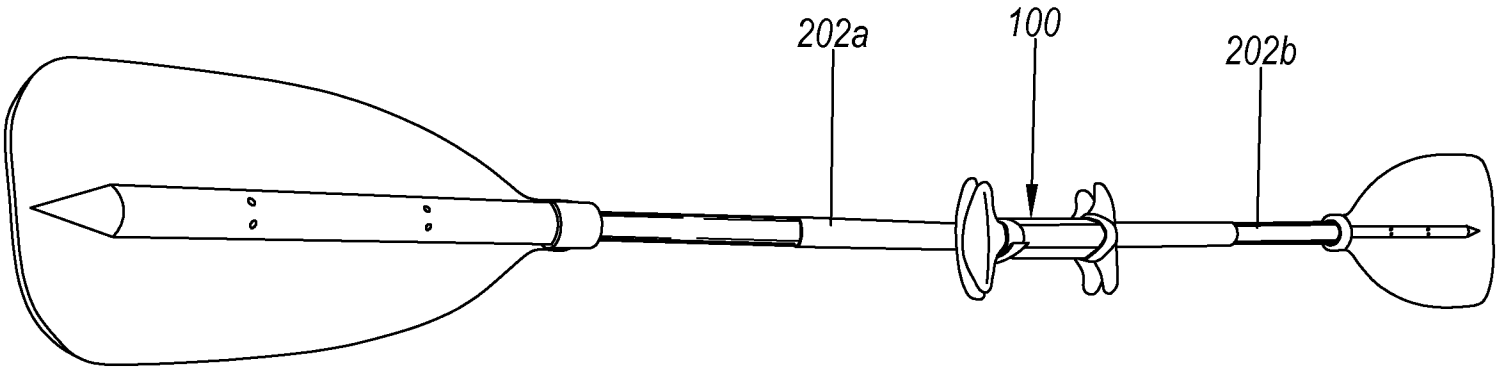
FIG. 2 illustrates an example a paddle converter securing a first canoe paddle and a second canoe paddle in a kayak paddle configuration.

FIG. 2 illustrates an example a paddle converter 100 securing a first canoe paddle 202*a* and a second canoe paddle 202*b* (collectively "canoe paddles 202") in a kayak paddle configuration. I.e., the first canoe paddle 202*a* and the second canoe paddle 202*b* can be used as a single double bladed kayak paddle.

Figure 3A:
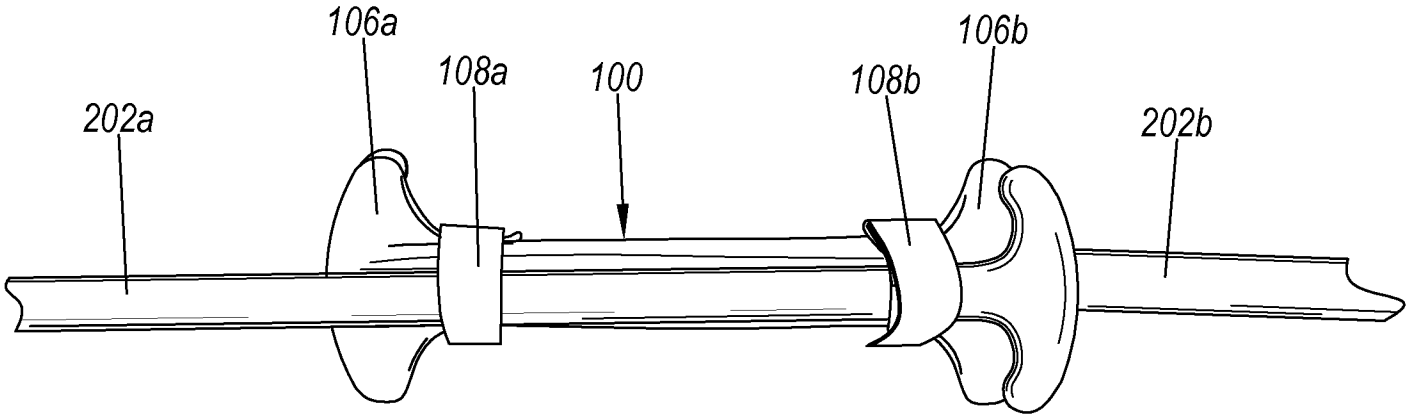
FIG. 3A illustrates a top view close up of a paddle converter securing a first canoe paddle and a second canoe paddle.
Figure 3B:
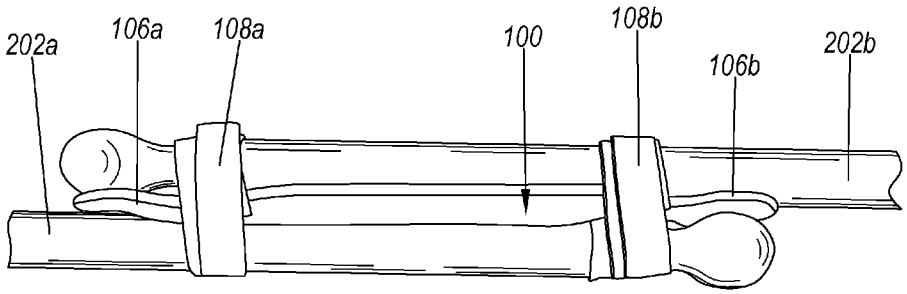
FIG. 3B illustrates a side view close up of a paddle converter securing a first canoe paddle and a second canoe paddle.

FIGS. 3A and 3B illustrate a close up of a paddle converter 100 securing a first canoe paddle 202*a* and a second canoe paddle 202*b*. FIG. 3A illustrates a top view close up of a paddle converter 100 securing a first canoe paddle 202*a* and a second canoe paddle 202*b*; and FIG. 3B illustrates a side view close up of a paddle converter 100 securing a first canoe paddle 202*a* and a second canoe paddle 202*b*.

FIGS. 3A and 3B show that the paddle converter 100 is placed between the first canoe paddle 202*a* and the second canoe paddle 202*b*. The grip of the first canoe paddle 202*a* is lined up with the first grip match 106*a* and the grip of the second canoe paddle 202*b* is lined up with the second grip match 106*b*. The first strap 108*a* is then wrapped around the shaft of the first canoe paddle 202*a* and the shaft of the second canoe paddle 202*b* at a first location. The second strap 108*b* is then wrapped around the shaft of the first canoe paddle 202*a* and the shaft of the second canoe paddle 202*b* at a second location. One of skill in the art will appreciate that although an unfeathered configuration is shown, the paddle converter 100 can include a twist that allows the first canoe paddle 202*a* and the second canoe paddle 202*b* to be feathered relative to one another.

Figure 4:
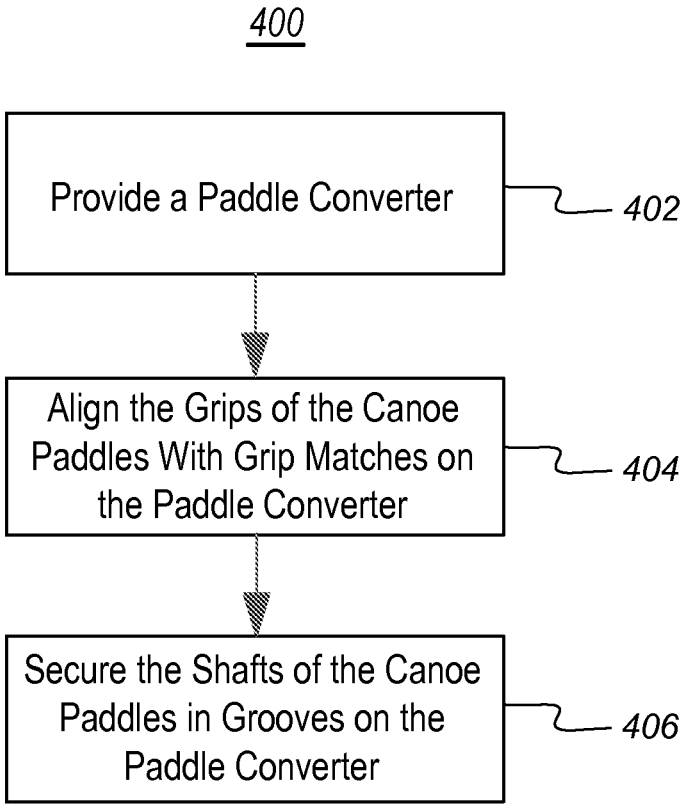
FIG. 4 is a flowchart illustrating a method of securing two singled bladed canoe paddles to form a single twin bladed kayak paddle.

FIG. 4 is a flowchart illustrating a method 400 of securing two singled bladed canoe paddles to form a single twin bladed kayak paddle. In at least one implementation, the method can be implemented using a paddle converted, such as the paddle converter 100 of FIG. 1. Therefore, the method 400 will be described, exemplarily, with reference to the paddle converter 100 of FIG. 1. Nevertheless, one of skill in the art can appreciate that the method 400 can be used with devices other than the paddle converter 100 of FIG. 1.

FIG. 4 shows that the method 400 can include providing 402 a paddle converter. The paddle converter can include a body configured to structurally support a first canoe paddle and a second canoe paddle. I.e., the body provides a structural intermediary between the canoe paddles, converting them into a kayak paddle. In addition, the body can include a twist or curve that allows the paddles to be feathered relative to one another if the user so desires. Further, the body can include any desired material that is of sufficient strength to secure the canoe paddles. For example, the body can be made of plastic, wood, metal or any other desired material.

By way of example, the body can be between 10 inches and 14 inches long (i.e., in the direction that aligns with the shafts of the canoe paddles). In particular, the body can be approximately 12 inches long. Additionally or alternatively, the body can be between 3 inches and 5 inches wide (i.e., perpendicular to the shafts when secured). In particular, the body can be approximately 4 inches wide. Proper dimensions are critical to ensure that the kayak paddle can be used in a normal manner and that the below advantages are obtained. The body can allow sufficient overlap to prevent rotation of the paddle shafts relative to one another without being overly bulky which would increase the weight and discomfort of the user. Further, the body can be sized to prevent rotation of the paddle blades relative to one another. I.e., the body can be sized and shaped to prevent a feathering configuration other than the configuration intended.

FIG. 4 also shows that the method 400 can include aligning 404 the grip of the canoe paddles with grip matches on the paddle converter. The grip matches can be configured to match the grip of the canoe paddle. I.e., the grip matches can be approximately the same size and shape as the grip of the canoe paddle. The first grip match can be opposite the second grip match along the major axis of the paddle converter.

FIG. 4 further shows that the method 400 can include securing 406 the shaft of the canoe paddles in grooves on the paddle converter. The grooves are configured to receive the shafts of the canoe paddles. I.e., the shafts of the canoe paddles are secured in the grooves. The groove can prevent rotation of the shaft relative to the body. I.e., the grooves can ensure that the shafts of the two canoe paddles remain straight or in line relative to one another when used as a kayak paddle. The grooves can be internal (i.e., the sides are the same depth as the body) or can be external (i.e., the sides protrude from the body).

Securing 406 can include wrapping a strap around the first shaft of the first canoe paddle, the second shaft of the second canoe paddle and the paddle converter at a first location and wrapping a second strap around the first shaft of the first canoe paddle, the second shaft of the second canoe paddle and the paddle converter at a second location. The straps can be used to secure the shafts of the canoe paddles within the groove. In particular, the first strap can secure the first shaft and the second shaft to the body in a first location and the second strap can secure the first shaft and the second shaft to the body at a second location. Two attachment locations can allows the shafts to remain in line in the desired configuration. One of skill in the art will appreciate that the two attachment locations can be replaced with a single long attachment location. I.e., if enough of the shaft is secured at a single location, then a single attachment will function equivalent to two attachment points. One of skill in the art will appreciate that the straps can include any desired material and/or fasteners. For example, the straps can include a hook and loop fastener, buttons, snaps or any other desired fastener. Although straps are used as exemplary herein, one of skill in the art will appreciate that any fastener configured to secure the shafts within the groves is contemplated herein.

One of skill in the art will appreciate that the straps can be secured to body of the paddle converter using attachments. The attachments can secure the straps in a fixed position relative to the body. In particular, the attachments can ensure that the straps are in correct position relative to the body. For example, the attachments can include a rivet, slots, snaps or any other means for attaching the straps to the body.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A paddle converter securing two singled bladed canoe paddles to form a single twin bladed kayak paddle, the paddle converter comprising:

a first canoe paddle having a grip and a blade at opposing ends thereof, with a shaft extending therebetween;

a second canoe paddle having a grip and a blade at opposing ends thereof, with a shaft extending therebetween;

a body securing the first canoe paddle and the second canoe paddle in opposite directions to form a single twin bladed kayak paddle, the body comprising:

a first groove on a first side of the body receiving the shaft of the first canoe paddle;

a second groove on a second side of the body receiving the shaft of the second canoe paddle, wherein the second side of the body is opposite the first side of the body;

a first grip match on a first end of the first side of the body, wherein the first grip match is configured to matingly receive the grip of the first canoe paddle thereby preventing rotation of the first canoe paddle relative to the body; and a second grip match on a second end of the second side of the body, wherein the second grip match is configured to matingly receive the grip of the second canoe paddle thereby preventing rotation of the second canoe paddle relative to the body, wherein the second end of the body is opposite the first end of the body;

a first strap securing the shaft of the first canoe paddle within the first groove and the shaft of the second canoe paddle within the second groove at a first location adjacent the first end of the body; and a second strap securing the shaft of the first canoe paddle within the first groove and the shaft of the second canoe paddle within the second groove at a second location adjacent the second end of the body.

2. The paddle converter of claim 1, wherein the body secures the first canoe paddle and the second canoe paddle in an un-feathered configuration.

3. The paddle converter of claim 1, wherein the first grip match includes:

a first portion that protrudes from the body in a first direction perpendicular to the first groove.

4. The paddle converter of claim 3, wherein the first grip match includes:

a second portion that protrudes from the body in a second direction perpendicular to the first groove;

wherein the second direction is opposite the first direction.

5. The paddle converter of claim 4, wherein the second grip match includes:

a first portion that protrudes from the body in the first direction; and a second portion that protrudes from the body in the second direction.

6. The paddle converter of claim 1, wherein the body is between 10 inches and 14 inches long.

7. The paddle converter of claim 6, wherein the body is approximately 12 inches long.

8. The paddle converter of claim 1, wherein the body is between 3 inches and 5 inches wide.

9. The paddle converter of claim 8, wherein the body is approximately 4 inches wide.

10. The paddle converter of claim 1, wherein at least one of the first and second straps includes a hook and loop fastener.

11. The paddle converter of claim 1, wherein at least one of the first and second straps includes a button.

12. The paddle converter of claim 1, wherein at least one of the first and second straps includes a snap.

13. The paddle converter of claim 1 further comprising: an attachment configured to secure the first strap to the body.

14. The paddle converter of claim 13, wherein the attachment includes a rivet.

15. The paddle converter of claim 13, wherein the attachment includes a slot.

16. The paddle converter of claim 13, wherein the attachment includes a snap.

* * * * *